US005560292A

United States Patent [19]

Knauer

[11] Patent Number: 5,560,292

[45] Date of Patent: Oct. 1, 1996

[54] PRINTING GROUP CYLINDER OF A WEB-FED ROTARY PRINTING MACHINE

[75] Inventor: Peter Knauer, Münster, Germany

[73] Assignee: MAN Roland Druckmaschinen AG, Offenbach Am Main, Germany

[21] Appl. No.: 546,353

[22] Filed: Oct. 20, 1995

Related U.S. Application Data

[62] Division of Ser. No. 429,814, Apr. 27, 1995, Pat. No. 5,505,127.

[30] Foreign Application Priority Data

May 2, 1994 [DE] Germany ..... 44 15 340.6

[51] Int. Cl.[6] ..... B41F 13/28

[52] U.S. Cl. ..... 101/216

[58] Field of Search ..... 101/216, 217, 101/218, 375, 247, 479

[56] References Cited

U.S. PATENT DOCUMENTS

| | | | |
|---|---|---|---|
| 4,953,462 | 9/1990 | Krober | 101/216 |
| 5,188,027 | 2/1993 | Fantoni | 101/216 |

FOREIGN PATENT DOCUMENTS

| | | |
|---|---|---|
| 3318316 | 12/1983 | Germany . |
| 3324811 | 1/1985 | Germany . |
| 0290853 | 11/1988 | Germany . |
| 9115471 | 4/1992 | Germany . |
| 4302149 | 7/1994 | Germany . |

*Primary Examiner*—Ren Yan

*Attorney, Agent, or Firm*—Cohen, Pontani, Lieberman & Pavane

[57] ABSTRACT

A printing group cylinder of a web-fed rotary printing machine is mounted by its journals on opposed side walls of the machine. A sleeve positioned on or about the cylinder may be slipped on or off of the cylinder through an opening in the side wall. During operation, the opening in the side wall is closed by placing a pair of sliding gates in their closed position. When it is desired to change the sleeve, the opening in the side wall is uncovered by displacing the sliding gates. In order to obtain good print quality, the bearing is formed of multiple interengaging rings, of which at least one is eccentrically shaped. The eccentric shape of the ring causes the axis of the printing group cylinder to move into either a print engagement or disengagement setting when the ring is slidably rotated. The eccentric ring is secured against turning when the sliding gates are opened.

6 Claims, 3 Drawing Sheets

PRINTING GROUP CYLINDER OF A WEB-FED ROTARY PRINTING MACHINE

This is a divisional of application Ser. No. 08/429,814, filed Apr. 27, 1995, now U.S. Pat. No. 5,505,127.

BACKGROUND OF THE INVENTION

1. Field of the Invention

The present invention relates to a printing group cylinder of a web-fed rotary printing machine and, more particularly, to the mounting of form cylinders and transfer cylinders in a printing machine so as to obtain good print quality.

2. Description of the Related Art

In web-fed rotary printing machines, there must be a constant line force between the cylinders printing the web to attain good print quality. Constant adjustment forces are also necessary between the form cylinder and the transfer cylinder. In order to fulfill this condition, the axial distance between the cylinders positioned against one another must always be the same. German Patent No. DE-OS 2614792 describes a printing machine in which the cylinders are equipped with bearer rings to provide constant adjustment forces between the form and transfer cylinders. In printing group cylinders which use printing-form sleeves or transfer-form sleeves, bearer rings cannot be located on the side of the cylinder on which the sleeve is either removed or slidably inserted. In order to obtain good printing results with cylinders of this type, great demands are placed on the cylinder bearings, particularly with respect to eliminating play of the cylinders. This is also true for the wall bushings which hold the cylinder bearings. However, these wall bushings are usually mounted on a side wall of the machine and have some degree of play. This is because it must be possible to turn the bushings in certain circumstances, as for example to enter either a print engagement or disengagement setting. It may also be necessary for the wall bushings to be movable.

It would therefore be desirable to provide a web-fed rotary printing machine which is able to obtain a good print quality while eliminating play on the part of the cylinders and allowing the bushings to be movable. It would also be desirable to provide such a web-fed rotary printing machine wherein a sleeve of the cylinder may be replaced while the cylinder maintains its position.

SUMMARY OF THE INVENTION

The present invention is based on the object of creating priming group cylinders with which good print quality can be obtained.

This object is attained in generic printing group cylinders by providing multiple interengaging rings within a bearing of the cylinder. At least one of the interengaging rings has an eccentric shape. Due to this eccentric shape, when the printing machine is in an operating mode and the rings are turned, the axis of the cylinder is caused to move between a print engaging and a prim disengaging setting. The rings are prevented from turning when the printing machine is in a non-operating mode. The printing group cylinders may be mounted in or on the side walls of the printing unit so as to have little or no play. Furthermore, the printing group cylinders of the present invention do not have bushings which must be mounted to the side wall in a pivoting or movable fashion; these bushings can therefore be mounted or even clamped to the wall so as to have no degree of play.

As a whole, this arrangement enables the attainment of good print quality.

When a sleeve on the printing cylinder is to be changed or replaced, the bearing of the printing group cylinder is uncovered. During such a sleeve change, the printing machine is in its non-operating mode and the eccentric ring is therefore unable to change its rotational position, so that the printing group cylinder also maintains its position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should further be understood that the drawings are not necessarily drawn to scale and that, unless otherwise indicated, they are intended to be merely conceptual in nature.

BRIEF DESCRIPTION OF THE DRAWINGS

In the drawings, where like reference numerals denote similar elements throughout the several views.

DETAILED DESCRIPTION OF THE PREFERRED EMBODIMENTS

Figure 1:
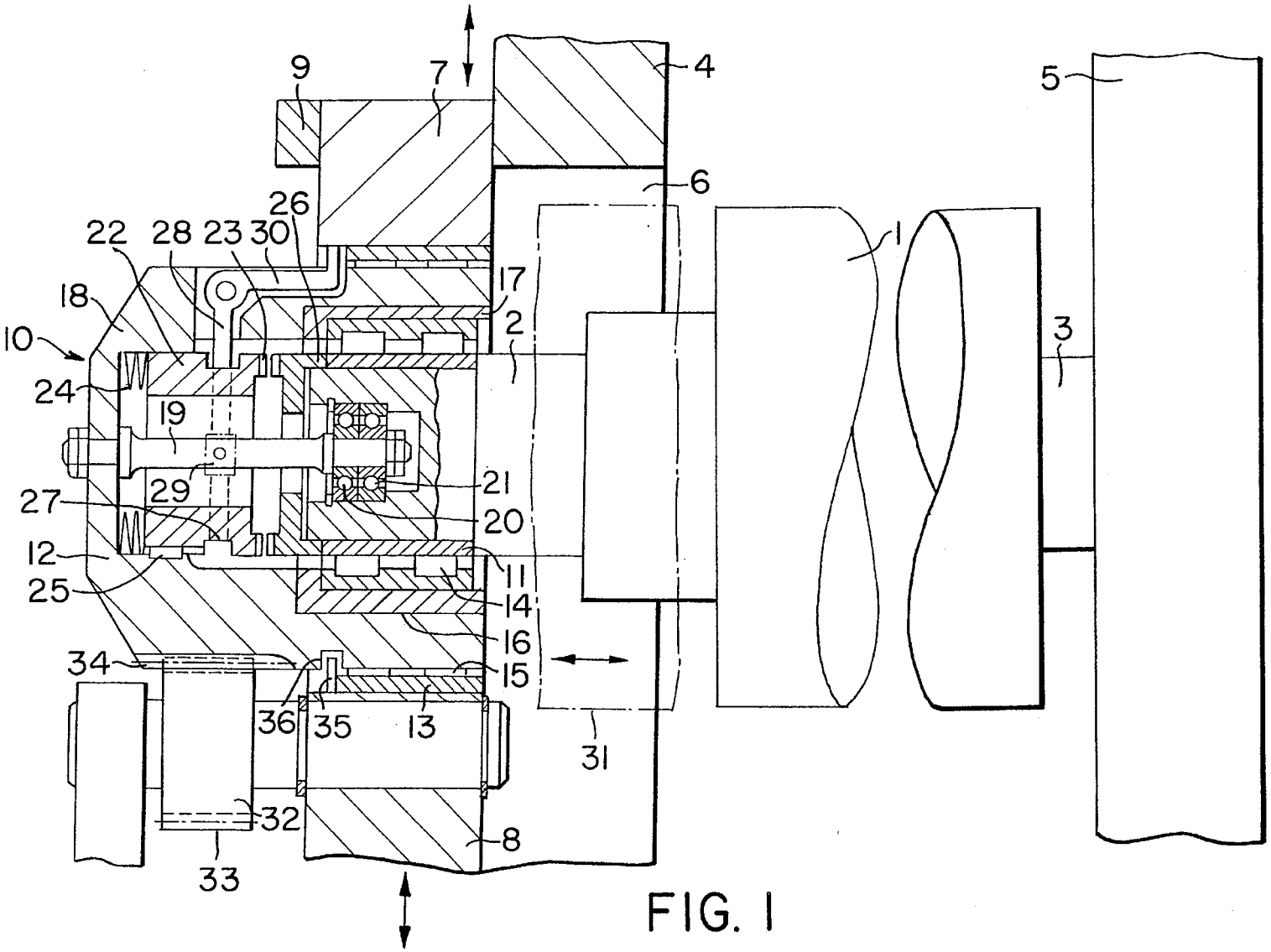
FIG. 1 is a cross-sectional view of a first embodiment of the present invention showing a transfer cylinder as the printing group cylinder.

FIG. 1 shows, in accordance with a first embodiment of the invention, a transfer cylinder 1 mounted by first and second journals 2, 3 to respective side walls 4, 5 of a printing group. The first journal 2 is indirectly mounted in the side wall 4, in an area in which the side wall 4 has an opening 6 that may be either closed or uncovered. Positioned adjacent to side wall 4, on a side opposite the transfer cylinder 1, are first and second sliding gates 7, 8. Based upon the position of the first and second sliding gates 7, 8, the opening 6 is either closed or uncovered. The sliding gates 7, 8 are movable at a right angle to the journal 2 in the direction indicated by the arrows shown respectively above first sliding gate 7 and below second sliding gate 8. A guide 9 for the first sliding gate 7 is positioned along a side thereof; a like guide for the second sliding gate 8 is not shown in FIG. 1.

In the closed position, shown in FIG. 1, the sliding gates 7, 8 retain or maintain a bearing 10 of the journal 2 in a stable position. The bearing 10 contains three interengaging rings 11, 12, 13 which are mounted to one another. The inner ring 11 is positioned on the journal 2 and is mounted within the middle ring 12 using a two-row cylindrical roller bearing 14.

The middle ring 12 is, in turn, mounted to the outer ring 13 by a two-row needle bearing 15 that is positioned within the outer ring 13. Other types of roller bearings, or even slide bearings, may also be used to mount the inner, middle and outer rings 11, 12, 13, respectively, within one another. However, roller bearings are particularly well suited for defining a bearing having little or no play, as is desired in accordance with the present invention. The middle ring 12 is eccentrically shaped and can therefore, when turned, shift or move the axis of the transfer cylinder 1 connected thereto, so as to place the transfer cylinder 1 into either or between a print engagement setting and a print disengagement setting. To do this, the middle ring 12 has a boring 16 that is eccentric to the outer mantle, and within which the cylindrical roller bearing 14 is accommodated. Positioned between the cylindrical roller bearing 14 and the middle ring 12 is an eccentric ring 17 which provides the basis for selectively setting the position of the transfer cylinder 1. The eccentric ring 17 is mounted using a pressure fit engagement in a boring 16 defined within the middle ring 12. To adjust the eccentric ring 17, this pressure fit is offset with a hydraulic press connection (not shown). The adjustment itself may, for example, be carried out using a threaded spindle drive; adjustments of this type are well known in the art. The eccentric ring 17 can also be positioned within the middle ring 12 in a roller-mounted fashion.

The middle ring 12 is implemented as a bushing 18, to the base of which a rod 19 is attached. The rod 19 is also pivotally mounted at one end to the journal 2. At its opposite end, the rod 19 is pivotally mounted, using two deep-groove ball bearings 20, 21, in a boring of the journal 2. Other bearings which are similarly capable of absorbing an axial force may also be used in place of the deep-groove ball bearings 20, 21, for pivotally mounting the rod 19. In addition, a clutch 23, formed of a first clutch member 22 and a second clutch member 26, is disposed within the bushing 18. Positioned between the first clutch member 22 and the base of the bushing 18 are springs 24; the first clutch member 22 is variably movable against the force of the springs 24. These springs 24 may be in the form of disk springs. The first clutch member 22 is secured against rotation by an adjusting spring 25 positioned on a radially outer side thereof.

The first clutch member 22 works in conjunction with the second clutch member 26 which is attached, through the inner ring 11, to a face side of the journal 2. The first clutch member 22 includes a circumferential groove 27 within which a selector fork 28 engages with sliders 29. The selector fork 28 is mounted in the bushing 18 and extends through the first clutch member 22. In addition, a lever 30, which is activated by the sliding gate 7, is also attached to the selector fork 28.

When the transfer cylinder 1 is in its operating state, the sliding gates 7, 8 are located in the positions shown in FIG. 1 in which the gates clamp the bearing 10 on the outer ring 13 so as not to allow any play on the part of the cylinder in the closed operating position. In order to permit a rubber-blanket sleeve 31 to be either removed from or slid onto the transfer cylinder 1 through the opening 6 in the side wall 4, the journal 2 must be uncovered in the area of the opening 6. For this purpose, the sliding gates 7, 8 are operatively moved into their uncovered non-operating position remote or spread from the journal 2. The sliding gate 7 thereby releases the lever 30, together with the selector fork 28 attached thereto, causing the disk springs 24 to force the first clutch member 22 against the second clutch member 26 to thereby engage the clutch 23. The clutch 23 is thus implemented as a friction clutch, i.e. such that the confrontingly opposed or facing sides of the first and second clutch members 22, 26 carry or include friction coverings. The clutch 23 may also alternatively be implemented, by way of example, as a claw clutch or geared coupling.

During a change of the rubber-blanket sleeve 31, i.e, when the opening 6 in the side wall 4 is uncovered through outward displacement of the gates 7, 8, the engaged clutch 23 prevents the eccentrically-configured middle ring 12 from moving relative to the transfer cylinder 1. The transfer cylinder 1 itself is secured against rotation by a drive (not shown) to which the journal 3 is connected. Furthermore, when the opening 6 in the side wall 4 is uncovered, a device (not shown) acts on the journal 3 and holds the transfer cylinder 1 in floating suspension. The rubber-blanket sleeve 31, which is replaceable through the uncovered opening 6 in the side wall 4 of the journal 2, is depicted in FIG. 1 by dot-dash lines. After the sleeve 31 is replaced or changed, the sliding gates 7, 8 are again returned inward to the closed, operating position shown in FIG. 1. The transfer cylinder 1 is secured in position during this process as the position of the eccentrically-configured middle ring 12 is maintained by the sliding gates 7, 8.

An adjusting drive 32 of the middle ring 12 may also be coupled to the middle ring 12 when the sliding gate 8 is in its closed, FIG. 1, position. As noted above, adjustment of the middle ring 12 serves to set the print engagement and disengagement settings. In order to adjust the middle ring 12 in this manner, a pinion 33 is retracted to engage a toothed segment 34 of the bushing 18 and thereby define the adjusting drive 32. The rod 19 also helps to secure the bushing 18 against movement. Furthermore, the outer ring 13 includes or carries a metal piece or projection 35 that extends rearwardly inwardly from a side thereof. The metal piece 35 engages a slot 36 on the middle ring 12 to secure the outer ring 13 against movement relative to the middle ring 12 when the sliding gates 7, 8 are in the open position. Movement of the outer ring 13 can also be prevented in numerous other ways, such as through the use of a needle bearing 15 having axial fixation.

Figure 2:
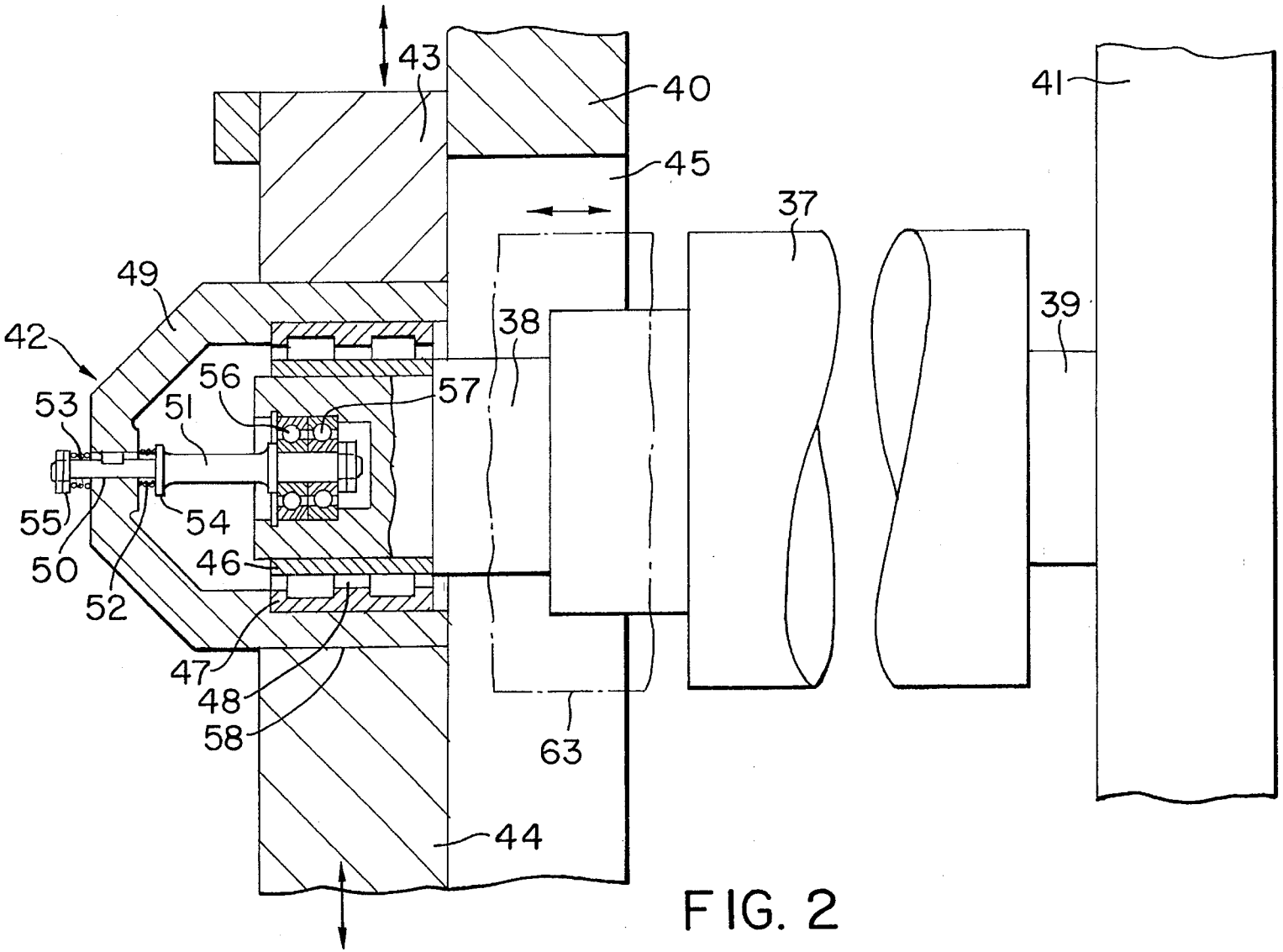
FIG. 2 is a cross-sectional view of a second embodiment of the present invention showing a plate cylinder as the printing group cylinder.

FIG. 2 depicts a second embodiment of the invention in which a form cylinder 37 forms the printing group cylinder. The cylinder 37 is mounted by its journals 38, 39 to respective side walls 40, 41 of a printing group. The bearing 42 of the journal 38 is held in position by the sliding gates 43, 44. The sliding gates 43, 44 are positioned in a movable fashion on and relative to the side wall 40 and are movable at right angles to the journal 38 in the directions indicated by the arrows shown respectively above and below the sliding gates 43, 44. In the position shown in FIG. 2, the sliding gates 43, 44 close an opening 45 defined in the side wall 40. The bearing 42 contains an inner ring 46 and an outer ring 47. These rings 46, 47 are interengaging and axially movable with relation to one another, and sandwich a two-row cylindrical roller bearing 48 therebetween. However, other roller bearings without axial fixation may also be employed, as for example needle bearings, slide-mounted rings, etc. The use of roller bearings is nevertheless preferred due to their ability for adjustment while not allowing play on the part of the bushing 49. This may be accomplished by shaping the boring of the inner ring 46, as well as the associated seat of the journal 38, in a conical fashion and axially adjusting the inner ring 46. The outer ring 47 is fixedly positioned within the bushing 49. Within the base of the bushing 49, centered with respect to the mantle of the bushing 49, is a boring 50. A rod 51 extends in a movable fashion through the boring 50. Located on both sides of the base of the bushing 49 are pressure springs 52, 53, each positioned between a side of the bushing 49 and a respective stop 54, 55 on the rod 51. One stop 54, 55 is positioned on each respective side of the bushing 49. Each of the pressure springs 52, 53 bears against the base of the bushing 49 and a respective one of the stops 54, 55 of the rod 51. In addition, the rod 51 carries, at or proximate its end opposite its attachment to the bushing 49, two deep-groove ball bearings 56, 57 which are positioned within a boring of the journal 38. The deep-groove ball bearings 56, 57 act in the same manner as the deep-groove ball bearings 20, 21 of the embodiment of FIG. 1.

In the operating state of the form cylinder 37, the sliding gates 43, 44 assume the position shown in FIG. 2 and clamp the bushing 49 in a secure position so as to restrict play. When there is axial movement of the form cylinder 37, the inner ring 46 shifts relative to the outer ring 47 without shifting the bushing 49 which is securely positioned within the boring 58 created by the closing of the sliding gates 43, 44. At the same time, during such axial movement of the form cylinder 37 the rod 51 extending through the base of the bushing 49 is pushed and a respective one of the stops 54, 55 compresses a respective one of the pressure springs 52, 53; the particular pressure spring that is compressed is dependent upon the sliding direction of the inner ring 46. To change the rubber-blanket sleeve 63, the sliding gates 43, 44 are moved to their uncovered position away or remote from the journal 38 and the bushing 49. This movement of the sliding gates 43, 44 uncovers both the opening 45 in the side wall 40 and the bushing 49, which is freed and thus deplaced or returned by the compressed spring 52 or 53 into its zero or unloaded position, thereby relaxing the compressed spring 52 or 53. The rubber-blanket sleeve 63 may then be changed by removing it and placing a new one through the opening 45. The change of the rubber-blanket sleeve 63, which is depicted in FIG. 2 by a dot-dash line, is accomplished by slipping the sleeve off of or onto the form cylinder 37 through the uncovered opening 45 in the side wall 40 and along the uncovered journal 38. The form cylinder 37, uncovered at its journal 38, is held in floating suspension by a device (not shown) carried on or secured to the side wall 41.

When the form cylinder 37 is again returned to operation by closing the sliding gates 46, 47, movement of both the inner ring 46 relative to the outer ring 47 and the form cylinder 37 along the entire shift path of each is once more possible. This is due to the use of a play-free, and optionally clamped, bearing for the bushing 49 in the side wall 40.

Figure 3:
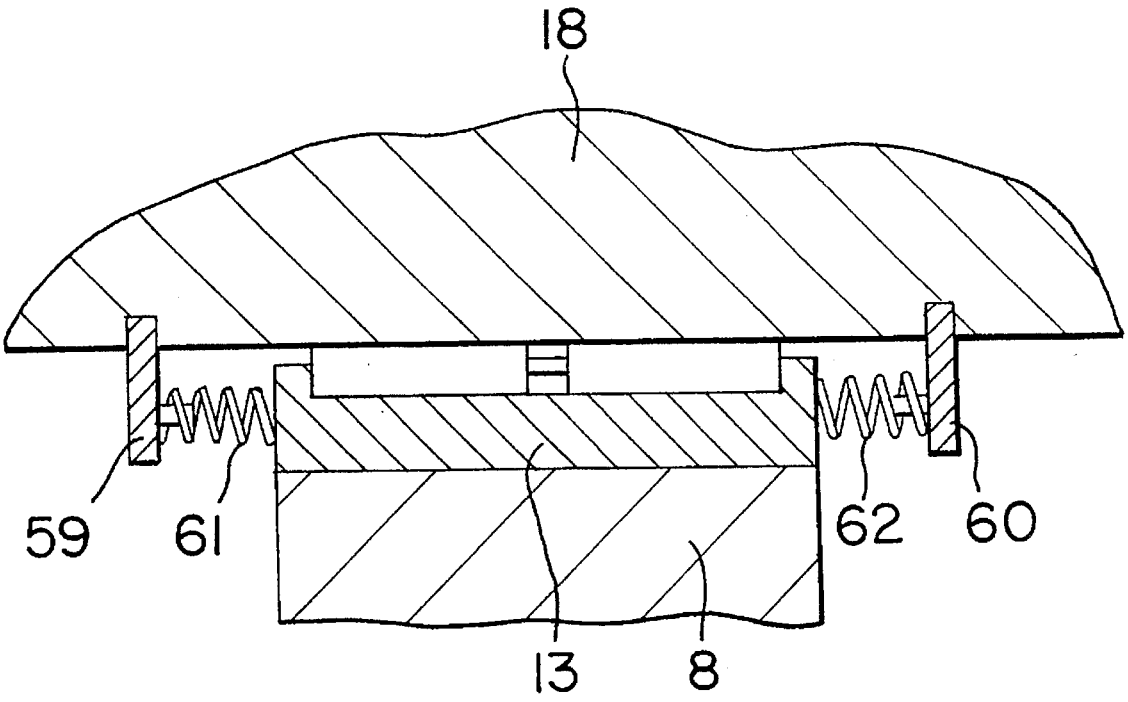
FIG. 3 is a cross-sectional view of a portion of the apparatus of FIG. 1 utilizing the arrangement of FIG. 2.

The arrangement shown in FIG. 2, which includes the axially moveable rings 46, 47 that are returned to their equilibrium or zero position by pressure springs 52, 53, can also be used with the printing group cylinder of FIG. 1. Such an arrangement, with respect to FIG. 1, is illustrated in FIG. 3 which shows the lower sliding gate 8, bushing 18 and outer ring 13.

The bushing 18 may also be provided with stops 59, 60 which support the pressure springs 61, 62. The outer ring 13 is positioned between the pressure springs 61, 62. During a sleeve change, i.e. when the sliding gate 8 is moved away or shifted into the uncovered position, the springs 61, 62 move the ring 13 into a zero or unloaded position relative to the bushing 18; the outer ring 13 had been moved out of this position when the bushing 18 was moved, i.e. upon the movement of a printing group cylinder.

It is also possible for the outer ring 13 to be moved indirectly, i.e. via an adjacent ring, into a zero position relative to the journal, as for example by mounting the outer ring 13 on the adjacent ring without any degree of sliding freedom. The device will then act on both the outer ring 13 and the adjacent ring for the zero or equilibrium setting.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover it should be recognized that structure and/or elements and/or method steps shown and/or described in connection with any embodiment of the invention may be incorporated in any other disclosed form or embodiment as a general matter of design choice. It is the intention, therefore, to be limited only as indicated by the scope of the claims appended hereto.

I claim:

1. In a web-fed rotary printing machine apparatus including a printing group cylinder, a cylinder-supporting journal extending outwardly from an end of the cylinder and defining a rotational axis of said cylinder, and first and second side walls between which the cylinder is supported, said first side wall including an opening defined therein through which the cylinder-supporting journal extends and through which a user-changeable sleeve carried on the cylinder is accessible, a bearing supportedly engaging said journal and including a plurality of interengaging rings, at least two of said rings being relatively movable in an axial direction along an axis of the cylinder and defining an axial equilibrium position with respect to each other, and movable means selectively movable between a first position in which said movable means prevents user access to said opening during normal operation of said printing machine apparatus and permits said relative axial movement of said at least two rings, and a second position permitting user access to said opening for access to the cylinder-carried sleeve and in which further means responsive for at least one of returning said at least two rings to the axial equilibrium position with respect to each other and securing said at least two rings against relative axial movement.

2. In a web-fed rotary priming machine apparatus in accordance with claim 1, said movable means comprising at least a gate movable between said first position in which said gate sufficiently covers said opening so as to prevent user access to said opening, and said second position in which said gate is displaced so as to sufficiently uncover said opening to accommodate user access to said opening.

3. In a web-fed rotary printing machine apparatus in accordance with claim 2, said gate being movable between said first position in which said gate abuttingly contacts said bearing so as to minimize cylinder play, and said second position in which said gate is spaced from said bearing.

4. In a web-fed rotary printing machine apparatus in accordance with claim 2, the further means being operated by said gate for permitting said relative axial movement of said at least two rings in said first position of the gate and for preventing said relative axial movement of said at least two rings in said second position of the gate.

5. In a web-fed rotary printing machine apparatus in accordance with claim 1, further comprising a plurality of roller mounts positioned between adjacent ones of said at least two rings for mounting adjacent rings together.

6. In a web-fed rotary printing machine apparatus in accordance with claim 1, wherein said movable means further comprises:

a bushing having a boring extending through a base thereof, and one of said at least two rings being mounted therein;

a rod extending through said boring and pivotally mounted on said journal; and first and second springs positioned on opposing sides of said boring, each engaging said rod and said bushing, whereby both said rod and said one of said at least two rings are moveable in the axial direction against a force applied by said first and second springs in said first position of the gate and said first and second springs urgingly move said one of said at least two rings into said equilibrium position in said second position of the gate.

* * * * *